US009080376B2

(12) United States Patent
Pellini et al.

(10) Patent No.: US 9,080,376 B2
(45) Date of Patent: Jul. 14, 2015

(54) GLASS-ENCLOSED CHAMBER AND INTERNAL VENETIAN BLIND HAVING SLATS OF IMPROVED REFLECTANCE AND DIFFUSIVITY OVER A WIDER SPECTRAL INTERVAL OF INCIDENT SOLAR RADIATION

(75) Inventors: Alessandro Pellini, Codogno (IT); Giovanni Nicolosi, Dresano (IT); Massimo Gentili, Milan (IT)

(73) Assignee: PELLINI S.P.A., Codogno (IT)

( * ) Notice: Subject to any disclaimer, the term of this patent is extended or adjusted under 35 U.S.C. 154(b) by 67 days.

(21) Appl. No.: 13/521,500

(22) PCT Filed: Sep. 27, 2010

(86) PCT No.: PCT/IT2010/000408

§ 371 (c)(1),
(2), (4) Date: Jul. 11, 2012

(87) PCT Pub. No.: WO2012/032551

PCT Pub. Date: Mar. 15, 2012

(65) Prior Publication Data

US 2013/0025799 A1 Jan. 31, 2013

(30) Foreign Application Priority Data

Sep. 10, 2010 (IT) ..... MI2010A1643

(51) Int. Cl.
*E06B 3/32* (2006.01)
*E06B 3/12* (2006.01)
(Continued)

(52) U.S. Cl.
CPC ..... *E06B 9/264* (2013.01); *E06B 9/386* (2013.01)

(58) Field of Classification Search
CPC . E06B 9/386; E06B 9/264; E06B 2009/2643; E06B 9/26
USPC ..... 160/107, 236, 166.1, 168.1 R, 176.1 R; 427/387, 388.1
See application file for complete search history.

(56) References Cited

U.S. PATENT DOCUMENTS 3,022,549 A * 2/1962 Cummings ..... 49/64
4,482,209 A * 11/1984 Grewal et al. ..... 359/883
(Continued)

FOREIGN PATENT DOCUMENTS

CH 586 835 A5 4/1977
GB 1 536 600 A 12/1978
WO 9926088 A1 5/1999

OTHER PUBLICATIONS

International Search Report, dated May 16, 2011, from corresponding PCT application.

*Primary Examiner* — Katherine Mitchell
*Assistant Examiner* — Jeremy Ramsey
(74) *Attorney, Agent, or Firm* — Young & Thompson

(57) ABSTRACT

Inside a glass-enclosed chamber is a Venetian blind connected to internal elements for operating it, the elements being workable from outside to raise, lower and incline the slats. The raw slats of the blind are obtained by moulding a rolled strip of aluminum alloy hardened by magnesium. The strip has not been lapped in order to maintain a degree of roughness on both surfaces, ready to receive a reflecting layer. Reflective stratification includes a layer of pure aluminum adherent to the body of the slat that serves to fix a reflective type of interferential dielectric multilayer. Average thickness of the layer of sputtered aluminum depends on the diffusivity of reflected radiation required in relation to the maximum height of the peaks of surface roughness on the body of the slats. Useful multilayers increase reflectance to levels averaging over 85% on a wide interval of wavelengths from near infrared to ultraviolet.

11 Claims, 5 Drawing Sheets

(51) Int. Cl.
*E06B 9/264* (2006.01)
*E06B 9/386* (2006.01)

(56) References Cited

U.S. PATENT DOCUMENTS 5,527,562 A 6/1996 Balaba et al.
5,760,981 A * 6/1998 Gillich ..... 359/883
5,839,492 A * 11/1998 Young ..... 160/107
6,627,307 B1 9/2003 Reichert et al.
7,054,065 B2 * 5/2006 Wolfe et al. ..... 359/572
7,896,056 B2 * 3/2011 Ben-David ..... 160/107
2002/0038694 A1 4/2002 Levert
2007/0070506 A1 * 3/2007 Watanabe et al. ..... 359/589
2007/0247713 A1 * 10/2007 Kikuchi et al. ..... 359/507
2011/0228415 A1 * 9/2011 Shei et al. ..... 359/883

* cited by examiner

GLASS-ENCLOSED CHAMBER AND INTERNAL VENETIAN BLIND HAVING SLATS OF IMPROVED REFLECTANCE AND DIFFUSIVITY OVER A WIDER SPECTRAL INTERVAL OF INCIDENT SOLAR RADIATION

FIELD OF APPLICATION OF THE INVENTION

The present invention concerns the technology for improving heat insulation in glass-enclosed chambers, and in particular a glass-enclosed chamber which contains a, Venetian blind having slats that possess greater reflectance and diffusivity over a wider spectral interval of incident solar radiation.

REVIEW OF THE KNOWN ART

Glass-enclosed chambers are usually of greater depth than the ordinary double glazing and can provide better screening against sun rays by the presence of hermetically-sealed internal means such as a Venetian blind, a roller blind or a pleated blind. Screening is graduated by operating the blind from outside. Glass-enclosed chambers with a Venetian blind inside offer a solution for effective control over the degree of brightness in daylight, especially where ventilation is controlled by centralized air conditioning, such as in trade fair buildings, exhibition halls, large stores, office blocks etc., and similarly on the façades of buildings for civil use. The increasing use of glass-enclosed chambers offering high heat insulation contributes to achieving a reduction in the amount of fuel needed for central heating in winter and for air conditioning in summer and therefore the ecological advantage of reducing the level of carbon dioxide in the air.

FIGS. 1, 2 and 3 show the structure of a glass-enclosed chamber 1 produced and sold by the applicant. Some innovations on the basic product have already been patented in a number of countries. The exploded perspective view in FIG. 1 shows a rectangular frame 2 laid between two panes of glass, 3 and 4, ultimately to be glued to the two lateral edges of the frame 2 to form the glass-enclosed chamber 1. The frame 2 is composed of four bars usually of aluminium of a closed cross section, held together by corner joints. A box-shaped part 5 is elastically fitted onto the top of frame 2 to contain the means (not shown in the figure) for working a Venetian blind 6, here shown fully let down into the chamber below box 5. In each slat 7 forming the blind 6 there are two suitably-spaced slots; a centrally situated cord 8 passes through the vertically aligned slots to raise or lower the slats.

FIG. 2 shows the front of the glass-enclosed chamber 6 with the glass casing 3 glued to the rectangular edge of the frame 2. The panes of glass 3 and 4 can be standard panes, without surface treatment, or else of the low emission type which means that their inner faces have been treated with coatings that selectively reflect some parts of the spectrum of solar radiation, principally among the ultraviolet rays (UV) and the near infrared (IR). FIGS. 3A, 3B and 3C show the same cross section of the glass-enclosed chamber 6 with the slats 7 in three angular positions. In FIG. 3A, each slat 7 rests horizontally on its own notch in two collapsible cord 'ladders' 9. The vertical cords of ladders 9 pass outside the long side of each slat 7, aligned with the cords 8 for pulling up the blind that pass through the slats. One end of the cords 8 and ladders 9 is fixed to a horizontal bar 10 placed underneath the lowest slat. The other end of the cords and ladders crosses the base of the box 5 and is fixed to its respective parts for raising and inclining the slats. The weight of the bar 10 enables the blind 6 to extend downwards keeping the cords 8 and the ladders 9 in tension while moving. The mechanism for downward and upward movement of the blind 6, as for that to incline the slats 7, are of a well-known type and will not be described. As an example, in the upper left-hand corner of the frame 2 there is a plug 11 to supply electric current to a motor, hermetically sealed in the box 5, for raising the blind 6. There are similar means in the box 5 for adjusting slat inclination that can vary only slightly less than 90°, one way and the other, in relation to horizontal. FIGS. 3B and 3C show two positions of the slats 7 inclined respectively downwards and upwards.

The slats 7 are made by forming an aluminium strip 16 mm wide and about 0.15-0.2 mm thick. The surface of the laminated, but not lapped, aluminium is roughened and can be oxidised on both faces. The slats can be mounted straight onto the cords to form the Venetian blind, or can first be painted on both faces using colours and shades chosen according to where and how the blind will be used. The glass panes, 3 and 4, can be of standard type without any surface treatment, or else the sides facing inside the glass-enclosed chamber can be treated for low emission by well-known processes involving application of suitable coatings able to make selective reflection of some parts of the spectrum of incident solar radiation, preferably near infrared. Special hygroscopic salts are usually put into the hollow part of the bars forming the frame 2. A gas mixture consisting of 90% Argon and 10% air is generally put inside the glass-enclosed chamber. Lastly, the perimeter of the glass-enclosed chamber 1 is sealed all round using suitable sealing material.

Reflectance of the painted slats depends on the pigmentation of the paint used; variations of reflectance in relation to wavelength reaches maximum levels according to the shade of colouring. Surface roughness of the slats presents peaks comparable to the wavelength of visible light, typically 500 nm, so that the surface produced by rolling can be seen. Surface roughness of the slats is to some extent useful because it increases the diffusivity of reflected radiation and avoids unpleasant glare.

The experimental dashed curve in FIG. 4 shows the trend of the percentage R of reflectance as a function of the wavelength WL of incident radiation on the clean surface of a rough strip of aluminium used for forming the slats 7. The trend of reflectance R rises continually, though at different slopes, showing values from about 20% in the ultraviolet to a little below 80% in the near infrared. To estimate thermal efficiency when using a Venetian blind made with slats such as these, the following temperatures must be known:

T1—temperature on the outer surface of pane of glass 3 (standard) facing towards the outside of the building;

T2—temperature on the surface of the slats 7;

T3—temperature on the outer surface of the pane of glass 4 (standard) facing towards the inside of the building.

The wavelength interval, where it is believed that there is higher absorption and emission of radiation that contributes to the heating, hereinafter called interval of reference, is comprised between the 300 nm of ultraviolet and the 2,100 nm of near infrared. The source of light used in the heat test can reproduce the entire spectrum of solar radiation at a radiant power of 850 W/m$^2$, in accordance with a standard set by present regulations. While the heat test is in progress the blind 6 is fully lowered and the slats 7 fully turned to exclude the light and intercept maximum irradiated power. On illuminating the glass-enclosed chamber 1 at the front the following temperatures were read: T1=62° C.; T2=100° C.; T3=41° C. These are certainly not optimum values: the high value of T2 in particular may mean faster wear on the elements inside the chamber 1, while the high value of T3 indicates the need for a more intensive use of the air conditioning system. No improvement is obtained by the use of painted slats.

DESCRIPTION OF THE TECHNICAL PROBLEM

In situations of intense solar radiation, as often occur at certain latitudes in the summer, a control over the temperature of parts inside a glass-enclosed chamber is of crucial importance for securing approval by the user. Present regulations, aiming at a reduction of energy consumption in new buildings, require that windows and the like shall satisfy certain criteria. This also applies to glass-enclosed chambers and manufacturers must therefore ensure that they are designed to fulfil these requirements or, more generally speaking, that they satisfy standards of comfort for those inside the building. As glass-enclosed chambers are sealed, it is no easy matter to extract internal heat which by raising the inside temperature favours expulsion of heat through its walls. If the metal slats become overheated, the blind becomes a source of undesired radiation that heats the other parts inside the chamber, such as cords, paint, motor, etc. adversely affecting the reliability of the product. Once the temperature of these parts exceeds 60°, they may release vapours that condense on the cooler surfaces of the glass which then become fogged up. Makers of glass-enclosed chambers that contain a Venetian blind therefore advise their clients against slats of a dark colour because their low level of reflectance means extra absorbed heat requiring dispersal.

When using reflectors like the slats of a Venetian blind inside a glass-enclosed chamber, allowance must be made for the various requirements imposed by the use made of reflectors, for example: a) mechanical resistance of the metal substrates necessary for the slat forming process; b) diffusivity of reflected radiation to avoid glare; c) increase in reflectance across the entire spectrum of the interval concerned, especially in the region of infrared that bears greater responsibility for heating; d) operative life of the glass-enclosed chamber; e) finally the costs of the various processes.

The present art, other than that referred to above, appears to have no means of satisfying all the requirements as here outlined.

U.S. Pat. No. 5,527,562 describes a reflector of unpolished rolled aluminium strip coated with a polymeric layer of an aromatic compound of silicon (silane) to make it perfectly flat and therefore suitable for application of reflecting layers applied by sputtering in a vacuum in the following order: aluminium (Al) about 60-100 nm' thick; silicon dioxide ($SiO_2$) about 70-110 nm thick; titanium dioxide ($TiO_2$) about 30-50 nm thick. As an alternative to the above polymeric levelling structure, reflectors in the art as known even earlier than U.S. Pat. No. 5,527,562, used a flat layer of aluminium oxide applied to the surface of a sheet of rough aluminium over which a flat layer of $SiO_2$ about 70 nm thick was laid for greater mechanical consistency and protection of the oxidised surface. The dielectric stratification $SiO_2$, $TiO_2$ sputtered onto the layer of aluminium, generates constructive interference in the reflected radiation able to improve reflectance within a suitable wavelength interval. This is due to the different indices of refraction of the materials and to the different thickness of the two dielectric layers. Teaching by the US patent and by the known art here mentioned refers mainly to the production of specular reflectors which, aiming at a sharper image, try to reduce the diffusivity of reflected light, contrary to what is required of the Venetian blind slats. If the intermediate layer is that of polymeric silane, specialist processing costs are higher, but if the intermediate layer is of aluminium oxide, the sputtered aluminium layer is laid over a dielectric layer of $SiO_2$. In either case overall stratification includes an intermediate levelling layer as a base for the subsequent reflecting non-diffusive stratification.

U.S. Pat. No. 6,627,307 B1 (application WO99/26088) describes a composite material for reflectors comprising a flexible metal support sufficiently rigid to be produced in rolls, for example aluminium, treated for surface adhesion to a roughened covering layer selectable in accordance with the degree of diffusivity of light reflected by the reflector, of organic polymerised material, on which a sputtered reflecting stratification is laid in the following order: a layer of pure aluminium; a first dielectric layer; a second interferential dielectric layer reflecting with the first dielectric layer; a final protective coating, 5-10 nm thick, of $SiO_2$. Contrary to the previous US patent, control of surface roughness of the initial metal substrate enables the diffusivity of reflected light to be graduated but, identical with said US patent, the surface of the initial layer must be covered with another of organic resin that has to be heat-reticulated before the reflecting stratification can be laid. There are also other different types of highly reflecting stratification, for visible and for ultraviolet respectively.

For more than one reason the stratifications described in the two US patents referred to here are not the best where production of slats for Venetian blinds to fit into a glass-enclosed chamber is concerned. One reason is that residual gas released by the intermediate organic layer, though minimum, accumulates over time and leads to misting on the glass that is more pronounced during the summer. Another reason is the need to make use of different reflecting stratifications to obtain the best reflectance in various spectral regions of the interval of reference. This means that a single stratification is unable to reflect simultaneously and effectively on several spectral regions present in solar radiation. A third reason is that it is impossible to obtain all the layers in one layer-laying process only, whether applied by sputtering or by an equivalent method, this because of having to lay and reticulate the intermediate layer of silane or organic resin.

PURPOSE OF THE INVENTION

Purpose of the present invention is therefore to overcome the drawbacks noted in the glass-enclosed chambers that contain Venetian blinds based on metal substrates to which reflecting and non-reflecting stratifications adhere. A particularly important purpose of the invention is to minimize the generation of heat inside the chamber in order to improve heat insulation in the frontages of buildings where these chambers are used, to lengthen the working life of its various components, and avoid misting on the glass. A further purpose of the invention is to simplify the process for manufacture of slats for Venetian blinds to be used inside glass-enclosed chambers, starting from an substrate of rolled metal, usually produced in rolls, ensuring for this latter the same characteristics of mechanical resistance, hardness, reflectance and surface diffusivity required for the slats.

SUMMARY OF THE INVENTION

To achieve these aims, subject of the present invention is a glass-enclosed chamber containing a Venetian blind connected to an internal mechanism for inclining the slats and, if required, for drawing them up or letting them down, the slat bodies being of hardened aluminium alloy, the surfaces roughened with peaks of controllable height, wherein, according to the invention, the slats receive on both faces a reflecting layer applied by sputtering or by some other known process of application, including:

- a layer of pure aluminium adherent to the roughened surface of the body of hardened aluminium alloy, of variable thickness according to the desired degree of diffusivity of the reflected radiation;
- a first dielectric layer of determined thickness superimposed to the layer of pure aluminium;
- at least a second dielectric layer of determined thickness superimposed to the first dielectric layer, the second dielectric layer having different chemical composition than the first dielectric layer and said first and at least second dielectric layers generating constructive interference in the reflected radiation such as to guarantee a reflectance (RA) greater on an average than 85% of the incident radiation within a wavelength (WL) interval comprised between the near infrared and the ultraviolet, as described in claim 1.

Further characteristics of the present invention considered innovative are described in the dependent claims.

In accordance with a first embodiment of the invention:

said first dielectric layer of silicon dioxide, $SiO_2$, 107 nm ±3% thick, in contact with the layer of pure aluminium;

said second dielectric layer of titanium dioxide, $TiO_2$, 19 nm ±3% thick, in contact with the first dielectric layer.

In accordance with a second embodiment of the invention:

said first dielectric layer is of silicon dioxide, SiO2, 107 nm ±3% thick;

said second dielectric layer is of titanium dioxide, TiO2, 19 nm ±3% thick.

In accordance with a third embodiment of the invention:

said first dielectric layer of titanium dioxide, $TiO_2$, 4.2 nm ±1% thick, in contact with the layer of pure aluminium;

said second dielectric layer of silicon dioxide, $SiO_2$, 97 nm ±1% thick, in contact with the first dielectric layer;

the reflecting stratification also includes a third dielectric layer of titanium dioxide, $TiO_2$, 29 nm ±1% thick, in contact with the second dielectric layer.

Alternative versions realized with two or three dielectric layers reveal optical, thermal and mechanical properties substantially equal those of the stratification described in claim one. Advantageously, reflectance remains stable at over 90% in near infrared from 1,300 nm upwards, exceeding 95% starting from 1,900 nm.

The body of the unfinished slats (before laying the reflecting stratification) is preferably made of an aluminium alloy hardened by the addition of 4-5% of magnesium, plus decidedly smaller percentages of other metals such as copper, iron, nickel, or of non-metals such as silicon and phosphorous. Control of the peaks of roughness can be done by checking the parameters of the rolling process for producing the rolls of metal used to form the slats.

According to one aspect of the invention, by allowing the peaks of up to 500 nm to form on the surface roughness, average thickness of the layer of aluminium laid is over 75 nm. As thickness of the layer of aluminium increases, the depressions in the roughness tend to fill up, thereby increasing the levelling of the surface of the slats, which in turn reduces the percentage of diffused radiation. The average thickness of 75 nm of sputtered aluminium is in any case sufficient to keep the dielectric stratification firmly anchored to the body of the slat in conditions of maximum diffusivity of reflected radiation. Optimum diffusivity of incident radiation can be attained by laying an average thickness of about 150 nm of aluminium by sputtering.

ADVANTAGES OF THE INVENTION

The glass-enclosed chamber of the present invention has none of the drawbacks noted in the previous versions. Confirmation of this is given by the degree of heat measured in a prototype chamber that only differs from the one used to obtain the dashed curve in FIG. 4 in that it contains a Venetian blind fitted with innovative slats. The following temperatures were measured in the prototype of a glass-enclosed chamber: T1=61° C.; T2=63° C.: T3=32° C. A comparison between these temperatures and the previous ones immediately shows a ΔT2 fall in T2 temperature on the slats of as much as 37° C., and an ΔT3 fall of 9° C. in T3 temperature on the surface of the glass inside the building. As the entry of heat inside the chamber mainly depends on the temperature' T2, the ΔT2 between the two measurements means less overall heating inside the glass-enclosed chamber and therefore less steam from the paints and/or produced by the moving parts of the blind (motor, gears, etc.), primary cause of misting (the so-called fogging effect) on the panes of glass. While the entry of heat inside the building depends mainly on the temperature T3, the ΔT3 between the two measurements therefore means more efficient thermal insulation of the façades of the buildings where the new glass-enclosed chambers will be used, and consequently greater comfort in the summer for people working close to these chambers, as well as a reduced need for air conditioning. Due also to the sputtered layer of pure aluminium firmly anchored to the surface of the laminated aluminium alloy body of the slats, the entire reflecting stratification can be directly anchored to the two faces of the slat, therefore without the need for any intermediate layer of organic material, yet another cause of misting. Lastly, the manufacturing process of innovative Venetian blinds for use inside glass-enclosed chambers is greatly simplified with a consequent reduction in production costs.

All the requirements listed above under a) and e) can therefore be simultaneously fulfilled by the glass-enclosed chamber of the present invention.

SHORT DESCRIPTION OF THE FIGURES

Further purposes and advantages of the present invention will be made clear by the following detailed description of an example of its realization and by the drawings provided for purely explanatory reasons in no way limiting the invention, wherein.

Figure 4:
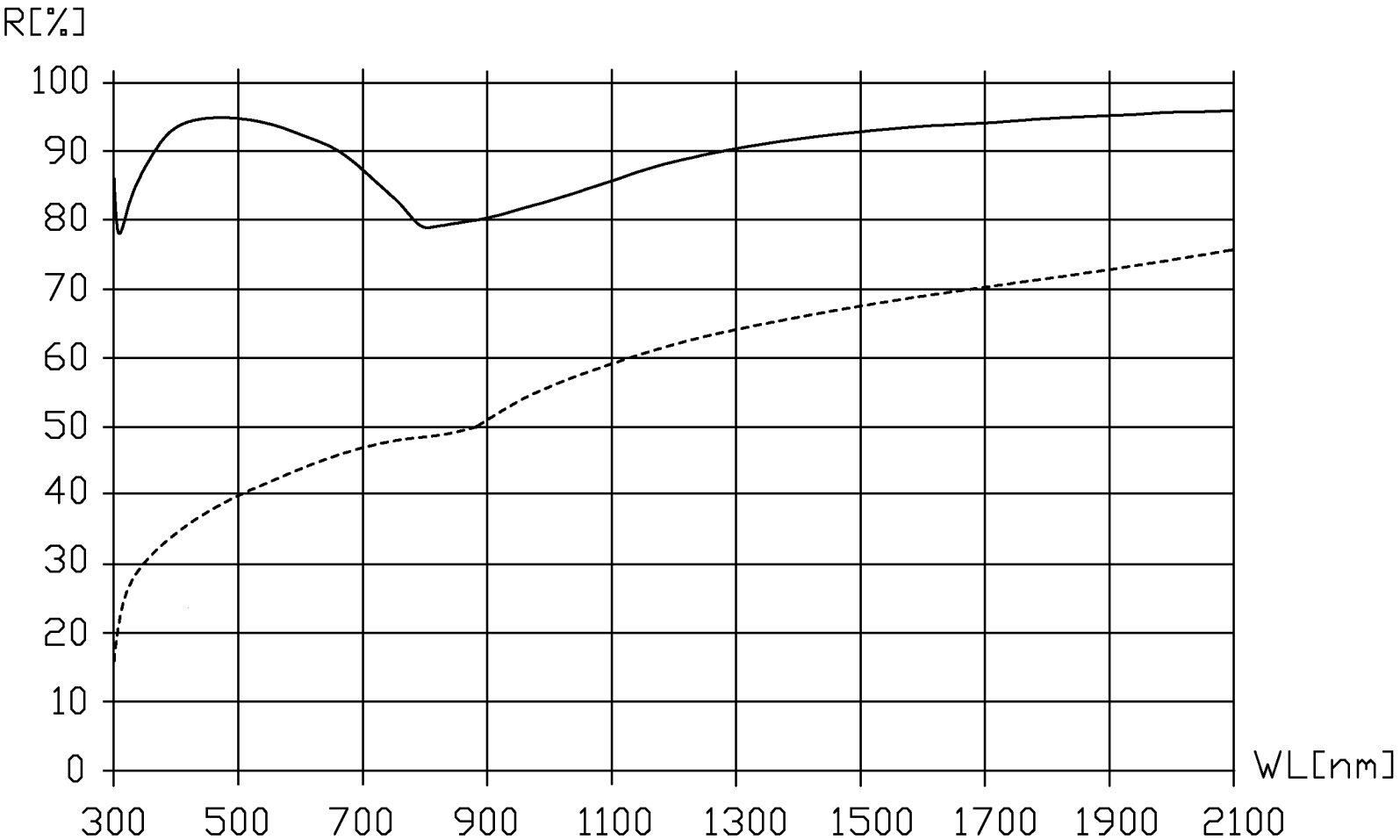

FIG. 4 shows a dashed curve between spectro-photometric measurements of reflectance of the non-pickled surfaces of the two faces of a strip of aluminium alloy used in forming the slats of a known type of Venetian blind to be placed inside the glass-enclosed chamber, compared with a solid curve, obtained in similar fashion, of the reflectance of non-pickled surfaces of the two faces of a strip of aluminium alloy treated by surface sputtering to use in forming the slats of a Venetian blind to be placed in the glass-enclosed chambers of the present invention.

Figure 1:
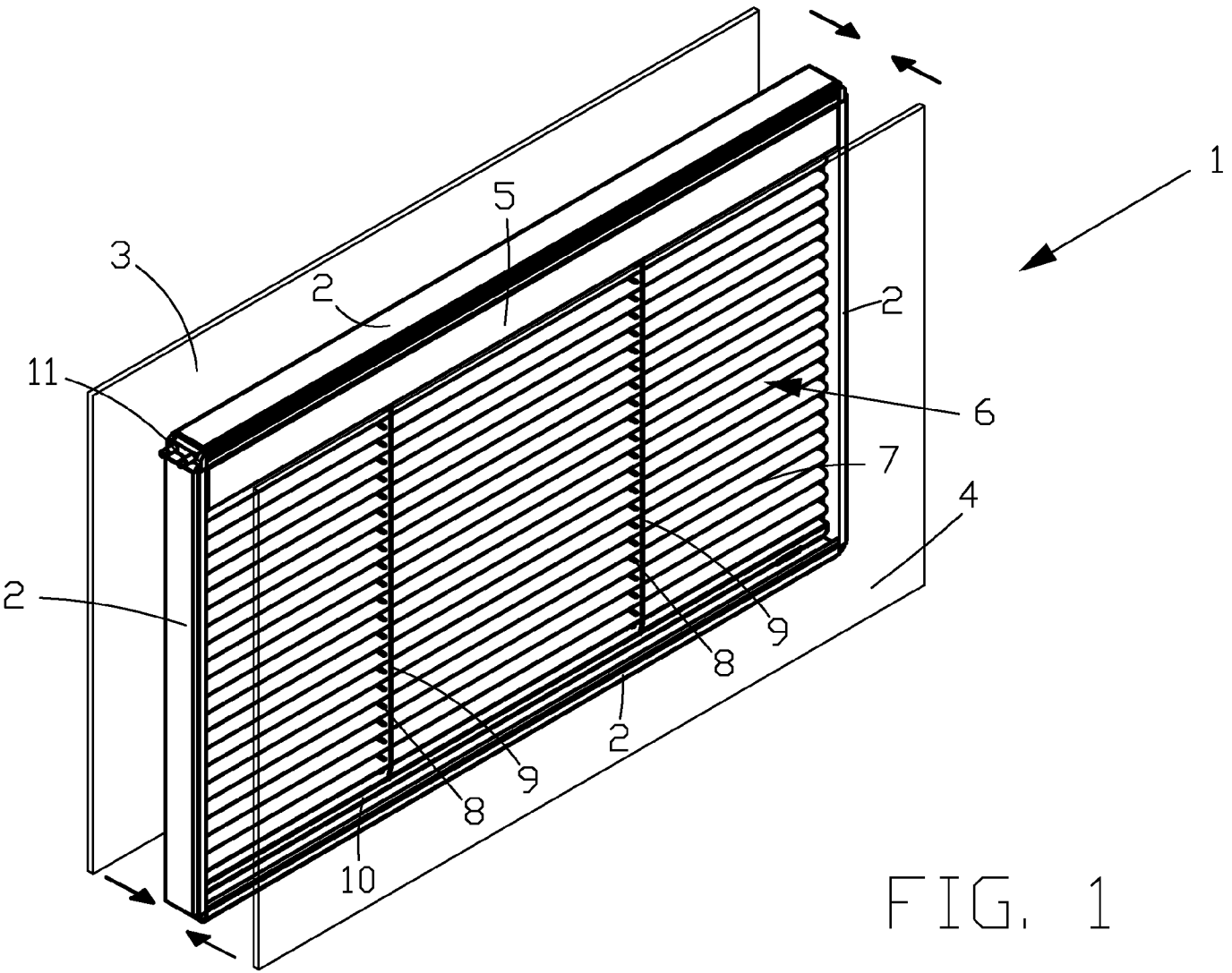
FIG. 1 is an exploded view in perspective of a glass-enclosed chamber of known mechanical construction: it includes a Venetian blind which may either be of the known type or like the blind of the present invention.
Figure 2:
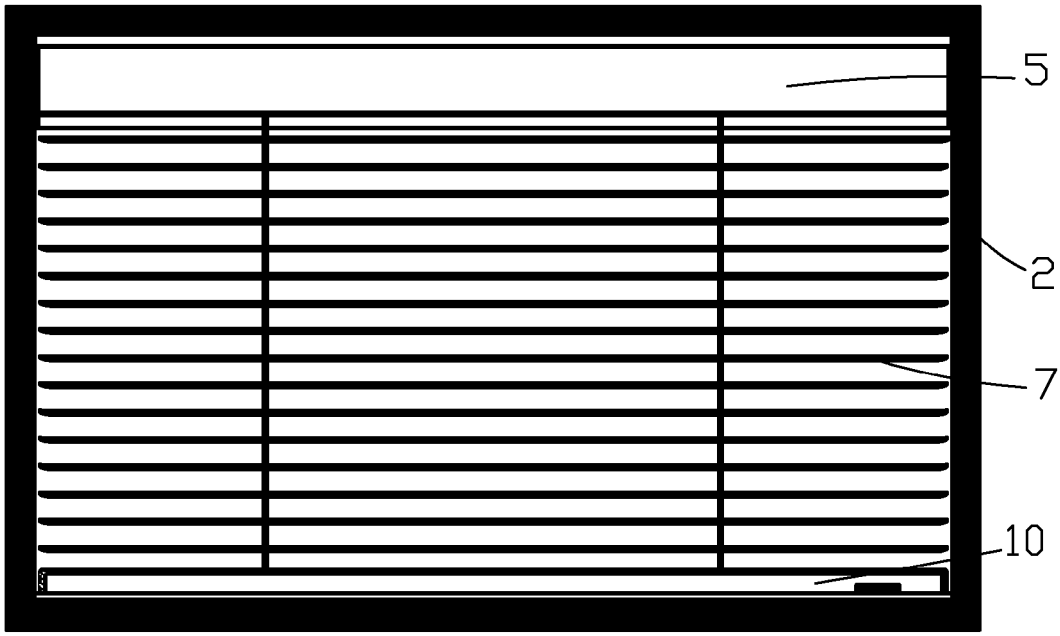
FIG. 2 is a front view of the chamber in FIG. 1.
Figure 3:
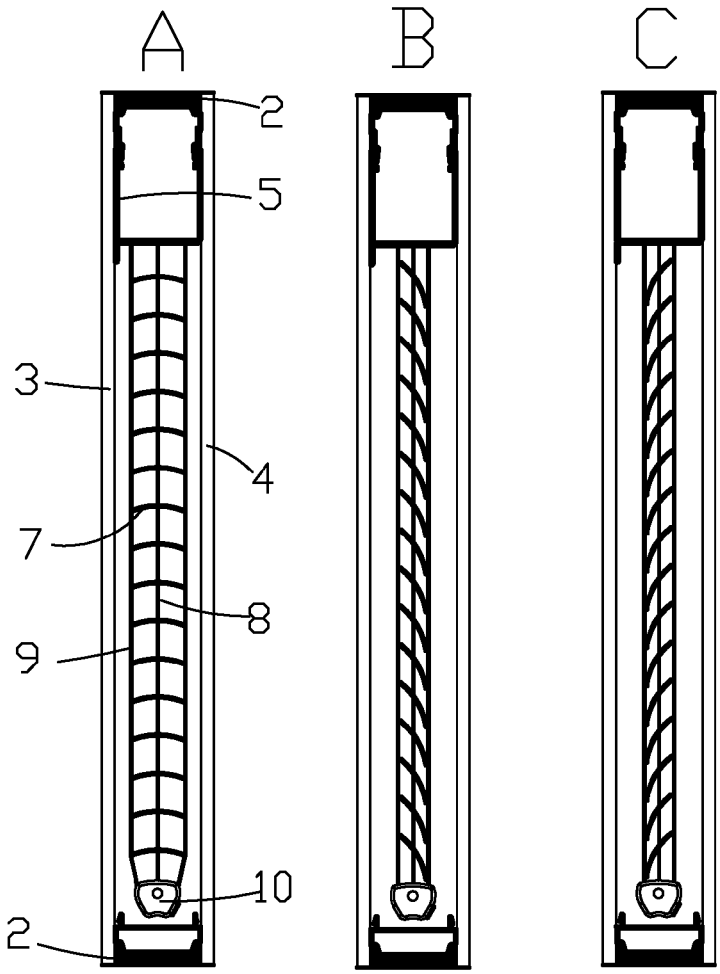
FIGS. 3A, 3B, 3C represent the same cross section of the glass-enclosed chamber in FIG. 2 with the slats of the blind in three positions: horizontal, inclined downwards, inclined upwards.
Figure 5C:
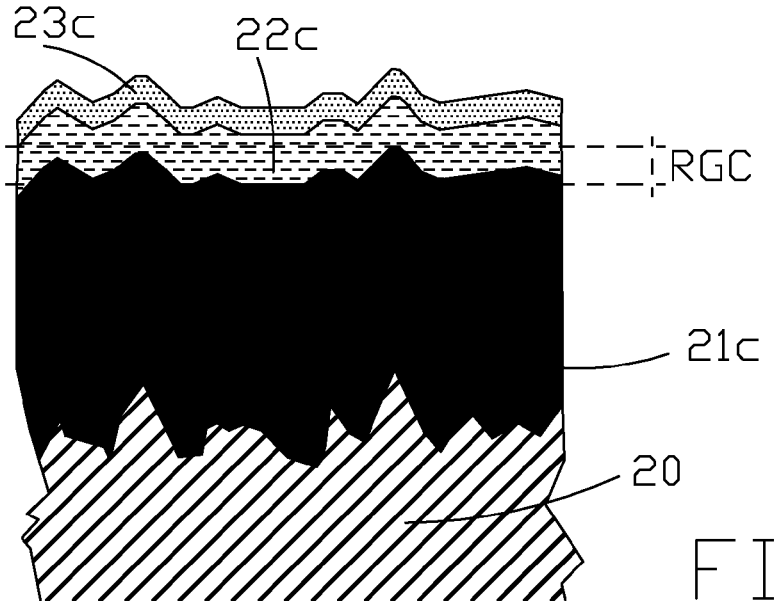
Figure 5B:
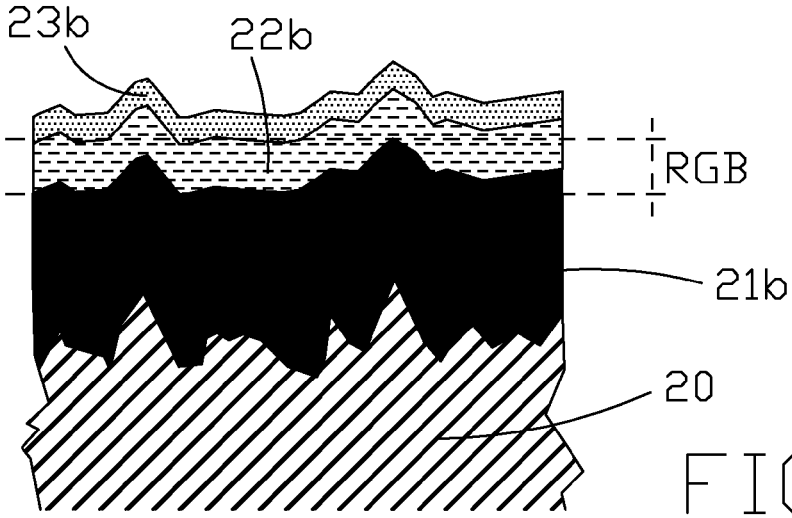
Figure 5A:
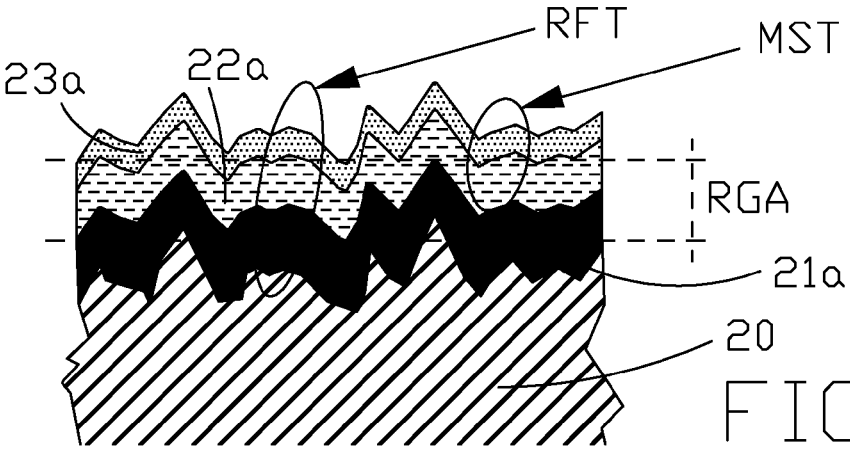

FIGS. 5A, 5B, 5C show a partial cross section of a slat in FIG. 3A complete with reflecting stratification according to the present invention, the surface of the internal metal layer being decreasingly roughened.

Figure 6:
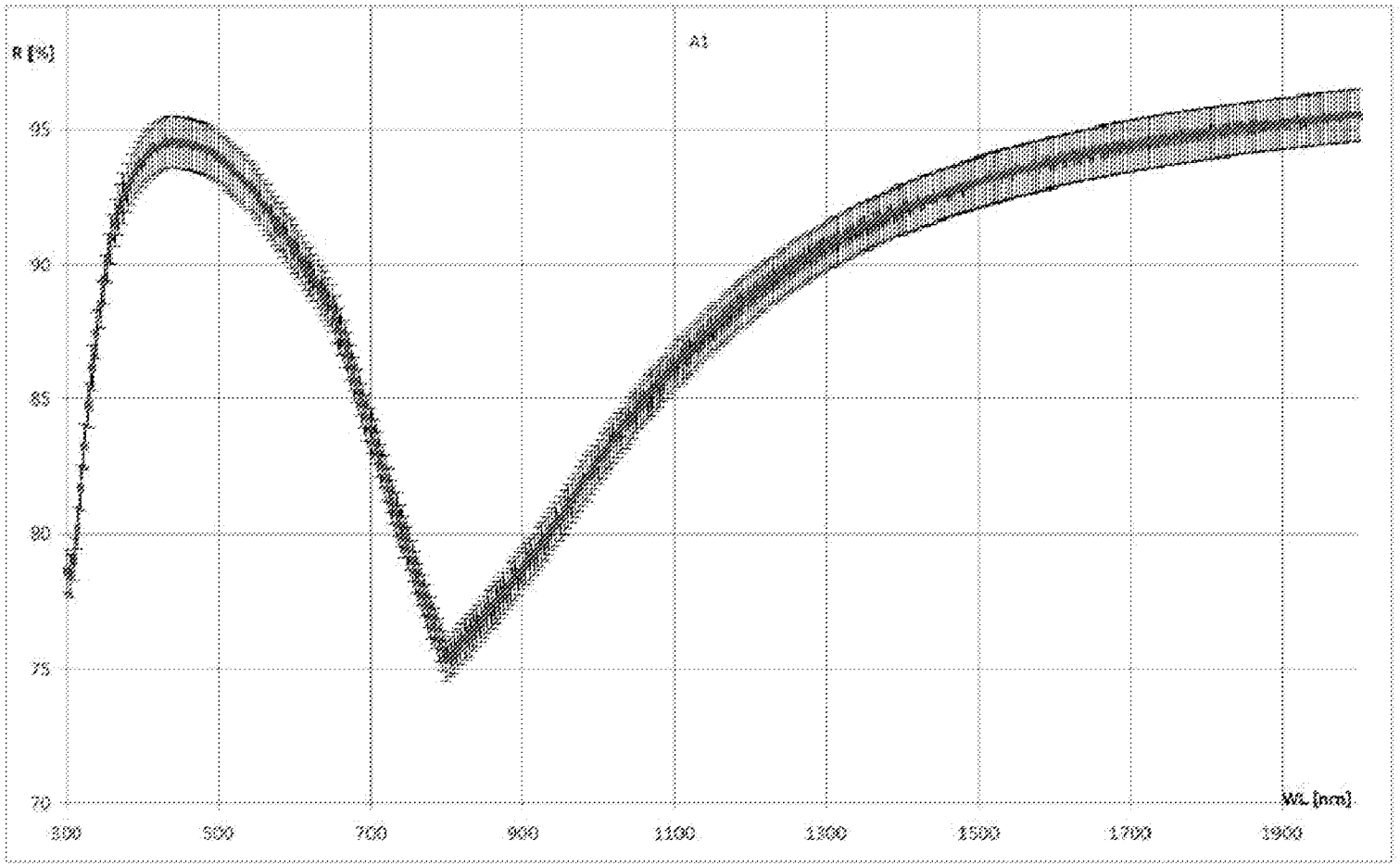

FIG. 6 shows the solid curve in FIG. 4 in greater detail, clearly indicating the bars of 2% error in measurements of reflectance given on the R axis, and the bars of 1% error of relative wavelengths given on the WL axis.

DETAILED DESCRIPTION OF SOME PREFERRED FORMS OF REALIZING THE INVENTION

As far as concerns the structural and hermetic characteristics of the innovative glass-enclosed chamber, the presence of means for raising the Venetian blind and for inclining the slats, the description given of FIGS. 1, 2, 3A, 3B and 3C remains valid in the one given below. However, as regards manufacture of the new Venetian blind 6, and particularly of the innovative slats 7, the aim has been to obtain a drastic reduction in the amount of energy absorbed by the slats 7 in reflecting solar radiation, promoting for this purpose an increase in reflectance while ensuring an optimum percentage of diffusivity at around 4% of incident radiation in order to reduce glare. The energy in any case absorbed by the slats is an intrinsic cause of a rise in their temperature to facilitate infrared re-irradiation inside the glass-enclosed chamber and convective circulation of the inert gases contained therein, so that the energy absorbed may be dispersed in the outside environment.

The same principle inspires the search for how best to anchor the reflecting stratification to the roughened surface of the substrate of aluminium alloy on the slats, seeing that they are to be used inside a glass-enclosed chamber. As the chamber has to be hermetic, the type of anchorage must differ from that used in the production of slats on Venetian blinds used outside a glass-enclosed chamber in which case absorption of heat by the slats is not of such crucial importance. As already mentioned, over a period of time higher slat temperature could cause serious difficulties inside the chamber partly depending on how the reflecting stratification is anchored.

The slats 7 are made of an aluminium alloy hardened by the addition of 4-5% of magnesium plus much smaller percentages of other metals such as copper, iron, nickel etc., or of non-metals such as silicon, phosphorous and others. Bars of this alloy are first hot-rolled to reduce the thickness, then pickled, washed in water and wound up into rolls. This is followed by cold-rolling at high speed to reduce thickness to 0.2 mm. The strip is then annealed in a controlled atmosphere to restore plasticity and adaptability. Lastly, it is given a further short roll to make it perfectly flat but with the required roughness, for example with peaks of about 500 nm on the flat surface.

At this stage the strip is ready for reflecting stratification to be laid on both faces. A single reflecting layer is not, however, sufficient to ensure high reflectance in a wide wavelength interval Consistent with this, figure SA shows a base layer 21*a* consisting of 95% pure aluminium of a pre-set thickness and adherent to the substrate 20 on the slat 7. Layer 21*a* underlies a multi-layer film MST consisting of two dielectric layers, 22*a* and 23*a*, of different materials, the one over the other and of fixed thicknesses. The thicknesses of the various layers, like the peaks and valleys on the surface roughness shown in the figure, are not the real ones. Layers 21*a*, 22*a*, 23*a* form an RFT reflecting stratification designed for maximum diffusivity. Average thickness of layer 21*a* is about 75 nm and because it is so thin it can do little to attenuate the roughness of substrate 20 so that average roughness of the reflecting surface is the maximum among the three cases shown. The profiles of surface roughness of dielectric layers 22*a* and 23*a* are substantially the same as that of the more internal layer 21*a*, determining a constant all-over thickness equal to theoretical. This is also valid for dielectric layers 22*b* and 23*b* and for dielectric layers 22*c* and 23*c*. Thickness profiles of the layer of pure aluminium and of the dielectric layers can be controlled by suitable action on the various physical parameters concerned in the layer-laying process. Surface roughness can be measured by known methods; an average roughness of substrate 20 can be calculated better to adjust the degree of levelling needed in order to achieve the required degree of diffusivity. An approximate idea of average roughness is shown in the figure by the difference (RGA) between peak height and the lowest level.

The reflecting stratification formed by layers 21*b*, 22*b*, 23*b* in FIG. 5B is characterized by optimum diffusivity at 4%. Layer 21*b*, with an average thickness of around 150 nm, sufficiently smoothes the roughness of layer 20 to an average surface roughness of the reflective surface halfway between maximum and minimum.

The reflecting stratification formed by layers 21*c*, 22*c*, 23*c* in FIG. 5C is characterized by a minimum diffusivity of around 2%. Layer 21*c*, with an average thickness of around 300 nm, effectively smoothes the roughness of substrate 20 so that roughness of the reflecting layer is minimal: Assuming RGA roughness as unitary, gives RGB=0.68 and RGC=0.47.

The MST multi-layer film is designed to function as a dielectric filter able to increase average reflectance of the untreated strip in the above spectral interval of reference. An accurate adjustment of thicknesses and the need to avoid contamination by elements extraneous to the materials forming the reflecting stratification, requires that the laying be carried out in a vacuum by physical type techniques such as sputtering or thermal evaporation. The unprocessed strip is unrolled by the application machinery and the layer of pure aluminium and dielectric layers are laid one after the other on both faces without interrupting the vacuum cycle. Technical details of how to apply the layers for the whole strip are not given as the technique is already known. The slats 7 to make the Venetian blind 6 are formed by a cold-moulding process on the previously stratified aluminium strip. Slot holes are made in the slats for the cords 8 used to raise the blind. One end of the cords 8 and of the ladders 9 is previously anchored to one end of the terminal bar 10, after which the slats 7 are carefully placed each on its rung of the cord ladder 9 and the cords 8 are passed through the vertically aligned slot holes. Lastly, the blind 6 is put into the glass-enclosed chamber 1 and the other ends of the cords 8 and the ladders 9 are joined to their respective operational parts inside the upper box 5, but workable from outside.

For reasons of economy and simplicity of the sputtering process, the materials chosen for the dielectric filter are silicon oxides, aluminium and titanium, limiting as much as possible the number of layers. Silicon dioxide $SiO_2$, alumina $Al_2O_3$ and titanium $TiO_2$ are well-known materials which can be easily laid down in a vacuum by sputtering. The increase in the fraction of solar radiation reflected by the innovative slats 7 compared with slats having no multi-layer film, is due to constructive interference between incident and reflected waves at the interface between the various dielectric layers, as also at the interface between the innermost dielectric layer and the layer of pure aluminium, and at the interface between the outermost dielectric layer and the inert gas inside the glass-enclosed chamber. Due to the increase in the component reflected by the dielectric multi-layer, a lesser fraction of solar radiation affects the layer of pure aluminium thereby reducing its absorption of heat. The indices of refraction of the various dielectric layers and respective thickness play their part in producing this effect; the greater the impedance mismatch between adjacent layers the greater the reflection. Greater mismatching of impedance can generally be obtained by alternating dielectric layers respectively to low and high indices of refraction, or vice versa. As an example, the indices of refraction ($n_i$) of the materials indicated are the following: $SiO_2$ $n_1$=1.46; $TiO_2$ $n_2$=2.48; $Al_2O_3$ $n_3$=1.77.

Table 1 below gives some combinations of multi-layer film able to increase the reflectance of the spectral interval of reference as indicated by Multi-layer 1 in FIG. 4 (solid curve) and in FIG. 6. The bottom line of Table 1 states the anchoring layer of pure aluminium (Al) common to all the multi-layers. The lines in the table indicate, from below upward, the order of application of the various layers.

TABLE 1

| | Multi-layer 1 | Multi-layer 2 | Multi-layer 3 |
|---|---|---|---|
| Layer 3 | — | $TiO_2$ (21.8 nm) | — |
| Layer 2 | $Al_2O_3$ (46.1 nm) | $SiO_2$ (97.2 nm) | $TiO_2$ (18.9 nm) |
| Layer 1 | $SiO_2$ (91 nm) | $TiO_2$ (4.2 nm) | $SiO_2$ (107.2 nm) |
| Bottom layer | For all multi-layers: Al (>75 nm) | | |

The function of reflectance shown in FIG. 6 is stably maintained above 90% in near infrared, from 1,300 nm upwards, exceeding 95% as from 1,900 nm. A drop occurs at the two sides of a depression situated in the visible zone of the spectrum with a minimum of 75% near to the 800 nm, that contributes to the aluminium-grey colour of the slats. Behaviour in the ultraviolet is also satisfactory with reflectance values tending to rise above 80%. The maximum diffusing effect of the bottom layer is found at the depression, a result of the degree of finish given to the aluminium alloy by the industrial rolling process. Thermal behaviour of the glass-enclosed chamber 1 can be analytically calculated applying mathematical expressions of the electromagnetic field and of thermal transport to a theoretical model of the chamber consisting of single finished elements connected one to another, characterized in their electromagnetic and thermodynamic aspects; this is however difficult to do even using a calculator. Results of thermal analysis can only confirm the maximum levels of temperature T1. T2. T3 the significance of which has already been explained. By making suitable simplifications, the power radiated inside the glass-enclosed chamber, by a 1 $m^2$ pack of slats including the reflecting stratification of Multi-layer 1 when maximum T2 temperature of the slats 7 is 63° C., can be theoretically established. For example, leaving aside the convective phenomena, it may be assumed that all the thermal power absorbed by the slats is re-radiated. By considering the individual slat as a black body, the Stefan-Bolzmann law $U=\sigma \cdot T^4$, with $\sigma=5.67 \cdot 10^{-9}$ $Jm^{-2}K^{-4}s^{-1}$ establishes that the radiated power of a black body is proportionate to the fourth power of its temperature. Even a slight fall in the temperature of a slat therefore means a substantial reduction in the power it irradiates. The power irradiated inside the innovative glass-enclosed chamber at the temperature of T2=63° C. measured on the surface of slats forming a pack of 1 $m^2$, is 0.893 $W/m^2$ which means that nearly all the incident energy is reflected and partially diffused towards the outside. In comparison with this, slats of the known art in a pack of 1 $m^2$, heated to the temperature of T2=100° C., irradiate 5.670 $W/m^2$. It follows that, inside the innovative glass-enclosed chamber, irradiated power is reduced by as much as 4.777 $W/m^2$.

Based on the description given of a preferred realization, it is clear that some changes may be made by an expert in the field without thereby departing from the sphere of the invention as will be explained by the following claims.

The invention claimed is:

1. A glass-enclosed assembly comprising:

a glass-enclosed chamber (1);

a venetian blind (6) located inside glass-enclosed chamber (1) said venetian blind being comprised of a plurality of slats (7), each slat having a shade of coloring;

an internal mechanism connected to said venetian blind, said internal mechanism for inclining the slats (7) of the blind, said slats being comprised of:

(i) a body (20) provided with two faces, the body (20) of said slats (7) being an aluminum alloy including 4-5% of magnesium, with a roughened surface at each face of the body (20) with peaks of height up to 500 nm, and;

(ii) a reflecting stratification layering (RFT) on each of the two faces, said reflecting stratification layering (RFT) to reflect an incident radiation as reflected radiation;

said reflecting stratification layering (RFT) consisting of:

a layer of at least 95% pure aluminum (21*a*) adherent to the roughened surface of the body (20), said layer of pure aluminum (21*a*) being of a thickness within a range of about 75 nm to about 300 nm;

a first dielectric layer (22*a*) superimposed to the layer of pure aluminum (21*a*);

at least a second dielectric layer (23*a*) superimposed to the first dielectric layer (22*a*), the second dielectric layer (23*a*) having a different chemical composition than a chemical composition of the first dielectric layer (22*a*), wherein said first dielectric layer (22*a*) and said at least second dielectric layers (23*a*) generate a constructive interference in the reflected radiation with a reflectance (RA) greater on an average than 85% of the incident radiation within a wavelength (WL) interval comprised between the near infrared and the ultraviolet, and an average thickness of said layer of at least 95% pure aluminum (21*a*) is selected to provide an average roughness (RGA), based on a peak height and lowest level of said layer, for the reflecting stratification layering (RFT) that is in a range from unitary to 0.47 such as to maintain the diffusivity of the reflecting stratification layering (RFT) not less than 2%.

2. The glass-enclosed assembly as in claim 1, wherein the average thickness of said layer of pure aluminum (21) is about 75 nm and provides an average roughness (RGA) of the reflecting stratification layering (RFT) with a unitary value, where diffusivity of the reflected radiation is a maximum allowed value, greater than 4%, according to the shade of coloring.

3. The glass-enclosed assembly as in claim 1, wherein the average thickness of said layer of pure aluminum (21) is about 150 nm and provides an average roughness (RGA) of the reflecting stratification layering (RFT) of a value equal to 0.68, where diffusivity of reflected radiation is near 4%.

4. The glass-enclosed assembly as in claim 1, wherein the average thickness of said layer of pure aluminum (21*a*) is about 300 nm and provides an average roughness (RGA) of the reflecting stratification layering (RFT) with a value equal to 0.47 where diffusivity of reflected radiation is a minimum value allowed according to the shade of coloring, said value near 2%.

5. The glass-enclosed assembly as in claim 1, wherein:

said first dielectric layer (22) is of silicon dioxide, $SiO_2$, 91 nm ±3% thick, said second dielectric layer (23) is of aluminum dioxide, $Al_2O_3$, 46 nm ±3% thick.

6. The glass-enclosed assembly as in claim 1, wherein:

said first dielectric layer (22) is of silicon dioxide, $SiO_2$, 107 nm ±3% thick, and said second dielectric layer (23) is of titanium dioxide, $TiO_2$, 19 nm ±3% thick.

7. The glass-enclosed assembly as in claim 1, wherein said aluminum alloy includes percentages smaller than 4% of materials selected from the group consisting of copper, iron and nickel.

8. The glass-enclosed assembly as in claim 7, wherein said aluminum alloy includes percentages smaller than 4% of materials selected from the group consisting of silicon and phosphorous.

9. The glass-enclosed assembly of claim 1, wherein said reflecting stratification (RFT) is a sputtering layering.

10. The glass-enclosed assembly of claim 1, wherein the reflecting stratification layering (RFT) provides a reflectance i) above 90% from 1300 nm upwards, ii) above 95% from 1900 upwards and iii) above 80% in the ultraviolet.

11. The glass-enclosed assembly of claim 1, wherein a diffusivity of the reflecting stratification layering (RFT) is between 2% and 4%.

* * * * *